US005113637A

United States Patent [19]

Gelbard

[11] Patent Number: 5,113,637

[45] Date of Patent: May 19, 1992

[54] NESTED PLASTIC BAGS AND METHOD OF MANUFACTURE

[76] Inventor: Edward S. Gelbard, 11 av. Princesse Grace, Monte Carlo, Monaco, 98000

[21] Appl. No.: 557,926

[22] Filed: Jul. 25, 1990

Related U.S. Application Data

[62] Division of Ser. No. 322,651, Mar. 13, 1999, Pat. No. 4,989,994.

[51] Int. Cl.[5] ..... B65B 63/00; B31B 7/74

[52] U.S. Cl. ..... 53/429; 53/120; 53/447; 53/540; 53/581; 493/210; 493/379; 493/386; 493/388

[58] Field of Search ..... 493/210, 212, 214, 217, 493/379, 386, 389, 388, 195, 196; 53/120, 447, 429, 540, 581

[56] References Cited

U.S. PATENT DOCUMENTS 4,758,214 7/1988 deBin ..... 493/196
4,905,453 3/1990 Siebring ..... 53/429

*Primary Examiner*—Bruce M. Kisliuk
*Assistant Examiner*—Jack Lavinder
*Attorney, Agent, or Firm*—Darby & Darby

[57] ABSTRACT

An article of manufacture comprises a plurality of nested plastic bags for use in lining containers such as garbage cans or waste paper baskets. The assembly is manufactured by placing successive plastic bags over a jig. The upper edges of the plastic bags are adhered to each other, for example, by conventional heat sealing means. The adherence between individual bags is such that the innermost bag can be separated readily from the remaining bags after the assembly is placed within a container.

17 Claims, 3 Drawing Sheets

10
11
13
15
20
21
30
32
33
38
40
50
51
55
55a
55b
56a
56b
57
59
60
62
70
72
78
100
100a-100n

NESTED PLASTIC BAGS AND METHOD OF MANUFACTURE

This is a division, of application Ser. No. 332,651, filed Mar. 13, 1989 now U.S. Pat. No. 4,989,994.

This invention relates to plastic bags of the type, for example, used to line garbage cans, waste paper baskets and the like.

It is common in both residential and industrial use to line waste paper baskets or like containers with a plastic bag so that when it is desired to dispose of the contents of the basket, it is only necessary to remove the liner with its contents. In offices, a number of liners are sometimes inserted into the container one after the other so that the maintenance staff need not reline the container each time a filled liner is discarded.

The present invention provides a multiplicity of nested plastic bags which are manufactured and sold as a unit for insertion as a single assembly into a waste paper basket or like container, whereby a single bag can be filled and removed from the remaining bags of the assembly.

SUMMARY OF THE INVENTION

According to the invention, an article of manufacture comprising a plurality of nested plastic bags is manufactured by successively placing a series of plastic bags over a jig. The upper edges of the plastic bags are adhered to each other, for example by conventional heat sealing means. The adherence between individual bags either is such that the innermost bag can be readily separated from the remaining bags or the bags are perforated for ready separation.

THE DRAWINGS

FIG. 5 is a perspective view showing the bundle placed in a waste container or the like.

DETAILED DESCRIPTION

The invention contemplates a manual or automated process to manufacture a bundle of nested plastic bags. For the sake of explanation, the invention is described in conjunction with a fully automated process although in some cases it may be preferred to manufacture the individual bundles by hand.

Figure 1:
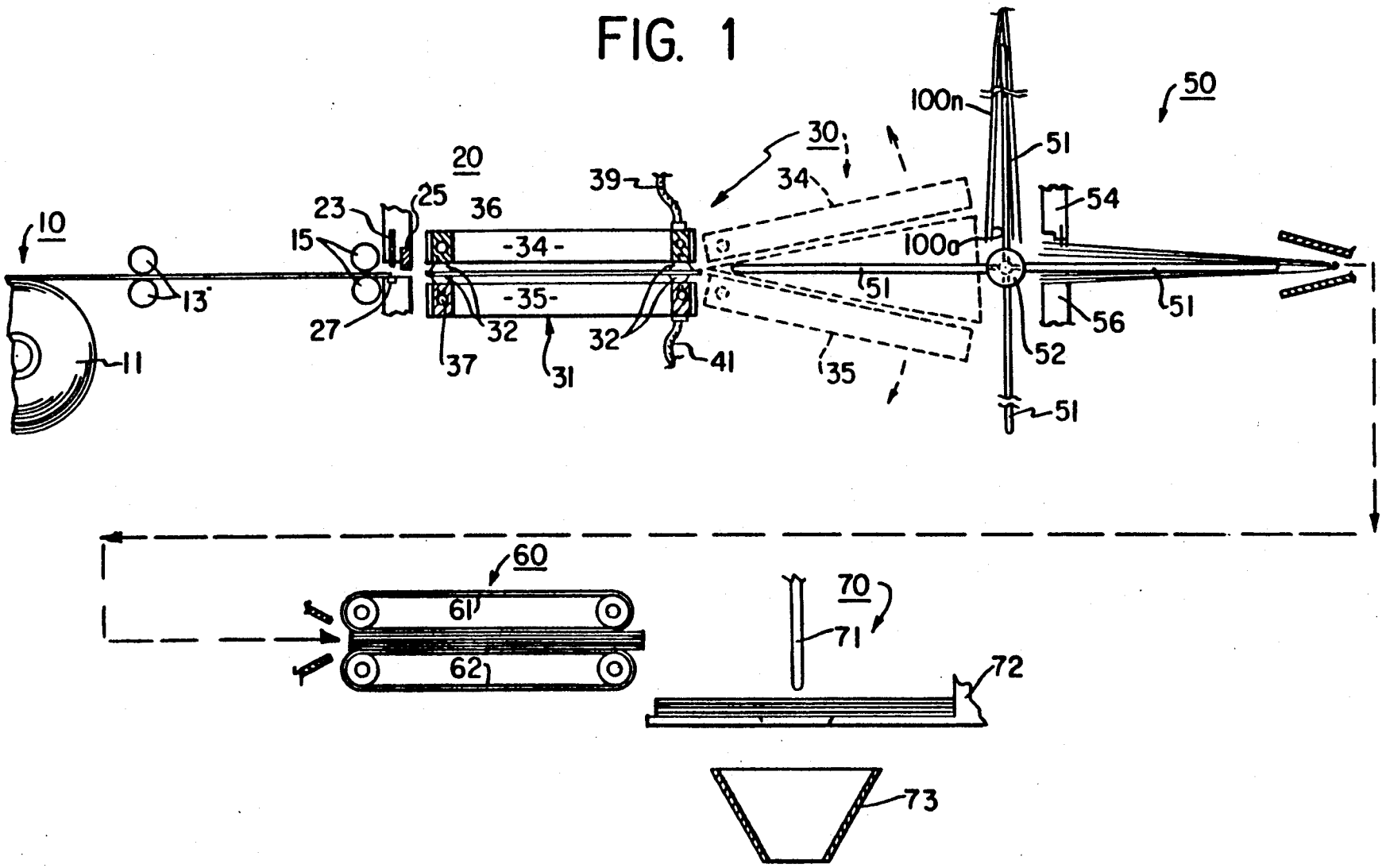
FIG. 1 is a side elevational view, partially in diagrammatic form, showing the apparatus used to manufacture a plurality of nested plastic bags in accordance with a preferred embodiment of the invention.
Figures 2, 7:
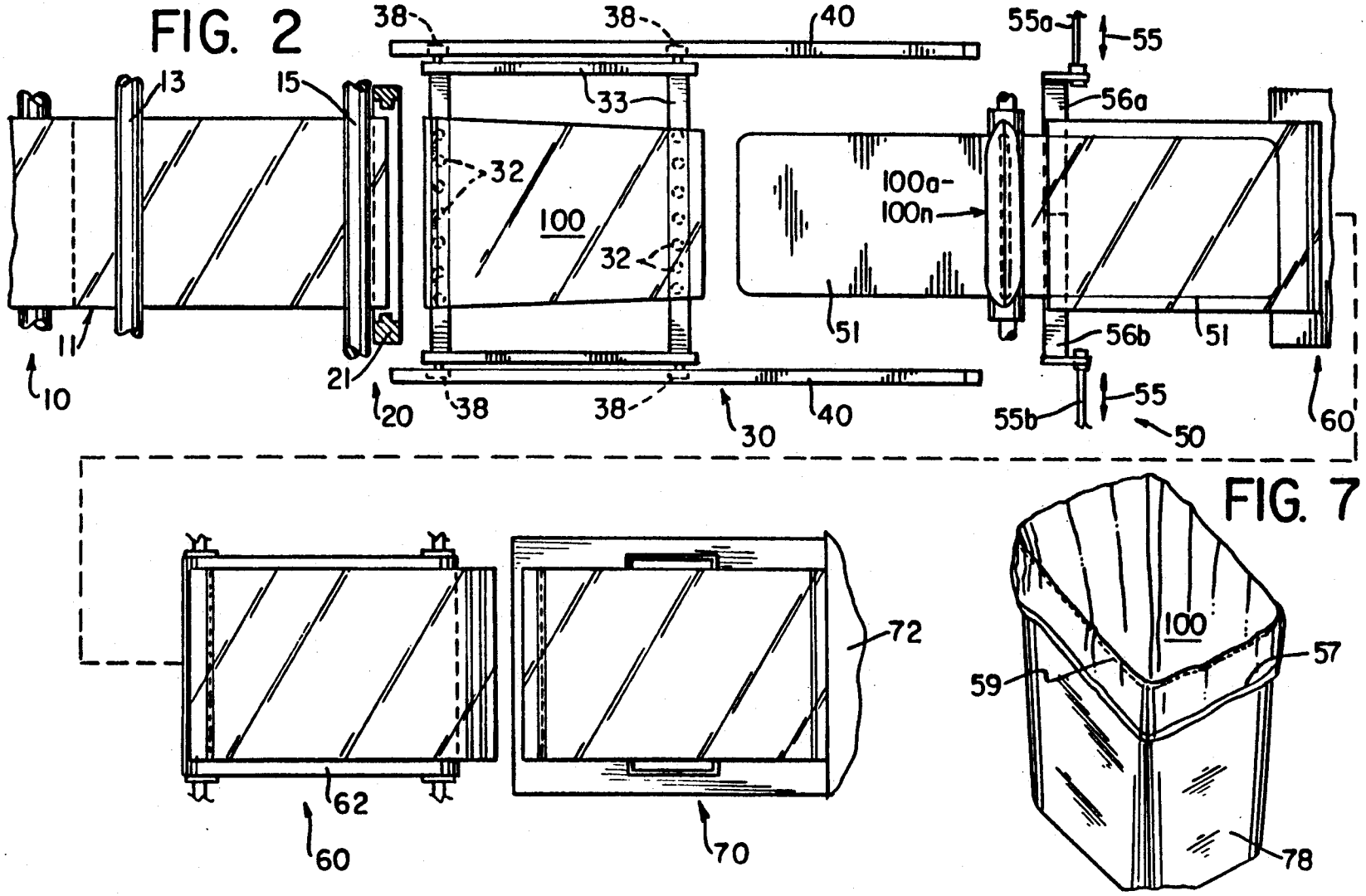
FIG. 2 is a top view of the apparatus shown in FIG. 1.

FIGS. 1 and 2 show apparatus which may be used to manufacture the nested plastic bags and the several functional stations. The stations shown in FIG. 1 are Supply 10, Cutting and Sealing 20, Bag Opening and Transport 30, Nesting Sealing and Perforation 50, Transfer 60, and Packaging 70.

A supply of plastic tubing 11 is transported by pinch rollers 13 and drive rollers 15 to the Cutting and Sealing Station 20 where plastic bags are formed. The supply 11 may be conventional polyethylene or other material of the type commonly used to line containers. Knife bar 23 and heat sealing bar 25 are housed within frame 21 and can contemporaneously cut and seal one end of tubing 11 to form a plastic bag. The plastic bag so formed is shown within the Bag Opening and Transport Station 30 being held between suction devices 32. Suction devices 32 are located on upper and lower housings 34, 35 which move horizontally to the position shown in phantom. Upper and lower housings 34, 35 are also pivoted to permit rotational movement around pivots 36, 37. Suction to the suction devices 32 is provided by air supply 39, 41. In operation, suction is maintained to devices 32 at the same time that bag opener and transporter 31 opens the bag and places it onto a jig 51 on a windmill. While jig 51 may be made out of many different materials and its dimensions are not critical, in the preferred embodiment, it is preferred that jig 51 approximate the shape of the flattened plastic bags and be about one-eighth inch thick. Bag opener and transporter 31 rolls on guide rollers 38 within upper and lower roller rails. FIG. 2 shows the upper roller rails 40 which form the guide path for the rollers 38 of upper housing 34.

The process of forming plastic bags, and opening and transporting them onto the jig 51 is automatically repeated a preset number of times until the desired number of clustered bags is obtained. It is contemplated that the diameter of the bags may increase slightly and progressively from the innermost bag 100*a* to the outermost bag 100*n* although this is not necessary The jigs 51 are rotated 90° around pivot 52 after the preset number of bags have been placed upon jig 51 as shown in FIG. 1. In operation, the windmill can be indexed to rotate a specified number of degrees per cycle depending upon the number of jigs pivoted around pivot 52. The embodiment of FIGS. 1 and 2 show four blades and the windmill would be indexed 90° per cycle. FIG. 2 shows the nested plastic bags on jig 51 in the vertical position after the windmill has been rotated 90°.

In accordance with the invention, the upper edges of the plastic bags are adhered together so that the assembly of nested bags can be handled as a single assembly while allowing the innermost bag to be removed readily from the remaining bags. In the automated process shown in FIGS. 1 and 2, this is accomplished by rotating the jig 51 containing a bundle of bags so that the upper edges of the bags can be positioned between the jaws 54 and 56, for example, of a conventional impulse sealer. The jaws 54 and 56 each contain a thermal heating element (not shown) such as a nickel chrome wire which is heated electrically when the jaws are closed. In the case of a wire, a linear heat seal is formed which may extend partially or entirely across the width of the jig. The energy applied must be sufficient to fuse all of the plastic bags together but no so great as to cause the innermost bag to adhere to the jig 51.

To facilitate separation of the innermost bag from the remaining bags during use, the jaws 54 and 56 may also incorporate conventional means for introducing a line of perforations 59 below the linear seal 57.

Since the jaws 54 and 56 extend linearly across the jigs, means must be provided to remove the jaws from the path of the jig when it rotates. Accordingly, as shown diagrammatically in FIG. 2, each of the jaws may in fact comprise separate halves, for example, as shown at 56*a* and 56*b* in the case of lower jaw 56 secured to rods 55*a* and 55*b* movable in the direction of arrows 55. When the windmill containing the jigs 51 is rotated, the rods 55*a* and 55*b* are actuated by a conventional mechanism (not shown) to pull the jaw sections 56*a* and 56*b* apart so that the jig 51 on which a bundle of bags had just been sealed and perforated can be rotated away from the jaws and the next jig containing the bundle which is to be sealed and perforated positioned between the jaws 54 and 56.

The next station is the transfer station 60 which includes upper and lower conveyors 61 and 62 (continue page 4, line 8).

These conveyors are indexed to remove the cluster of sealed and perforated nested bags from jig 51 and transport it to Packaging Station 70 as frequently as the windmill rotates 90°. FIG. 1 shows plunger blade 71 which pushes a cluster of nested bags through slotted support plate 72 and into guide chute 73 for packaging.

The assembly of nested bags is appropriately packaged for sale as a single article of manufacture. To help the customer locate the innermost bag, a collar made of paper or plastic may be applied over the top edges of the nested plastic bags. For the same purpose, the innermost bag 100*a* may be a different color from the remaining bags.

In use, the assembly is placed in a container to be lined, typically with the upper edges of the bags overlapping the container. When the innermost bag 100*a* is filled, that bag can be separated from the remaining bags in the assembly by applying sufficient force to rupture the perforated line 59.

Although the bags of the present invention are not gusseted, the invention can be used with gusseted bags or, for that matter, any type of plastic bag intended to be used as the liner for a container. Instead of a forming a single elongated linear seal, a plurality of discrete seals, for example six, may be formed. Another possibility would be an arrangement wherein a plurality of hot pins (for example six) are projected through holes in jig 51. This would create twelve circular seals circumferentially spaced around the upper edges of the bags. With such an arrangement, a perforated line may not be necessary. Optionally, a circumferential line of perforations may be applied around each of the heat seals.

Figure 3:
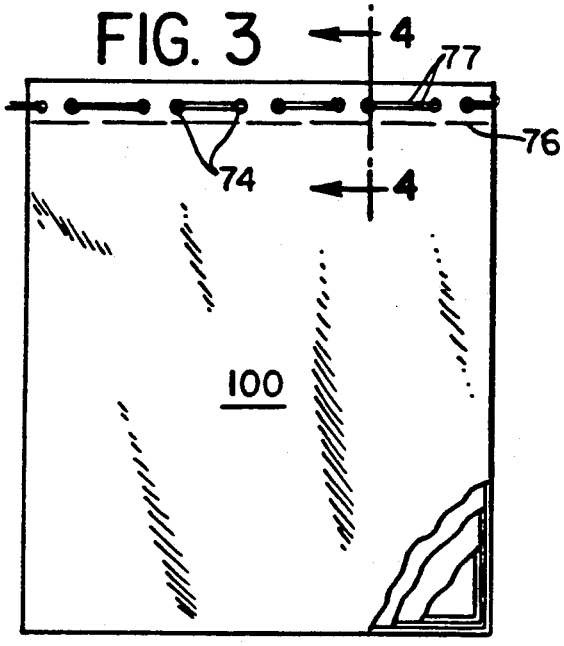
FIG. 3 is a front elevational view of a bundle of nested plastic bags in accordance with one embodiment of the invention.
Figure 4:
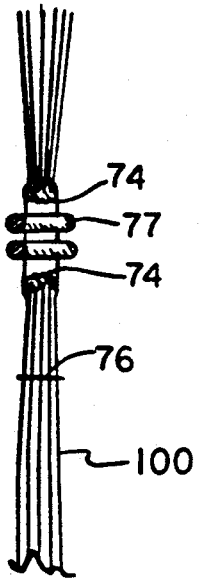
FIG. 4 is a side sectional view along the line 4—4 of FIG. 3.
Figure 5:
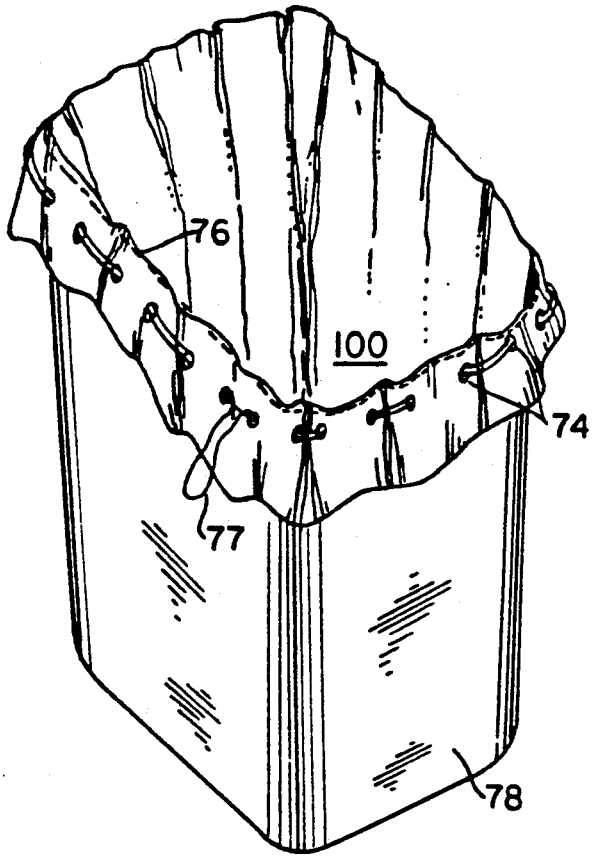

In the case of large bags, for example of the type that might be used to line garbage cans, the embodiment of the invention shown in FIGS. 3–5 is useful. In this construction, the bags are sealed together by the use of hot pins which make holes 74 through each of the bags with the individual bags being heat sealed together at the peripheries of the holes. A line of perforations 76 is formed immediately beneath the holes 62 and a conventional drawstring 78 is threaded through the holes 74. In use, the bundle is placed within a garbage can or like container 78 (FIG. 5), the top edges folded over the container and the drawstring pulled causing the garbage can to be tightly gripped. It is then a very simple matter to separate each of the individual plastic bags from the bundle at the perforated line 76 as each bag is filled.

Other processes may be used to cause the upper edges of the bags to adhere together to provide an assembly of nested bags. Also contemplated is the possibility of using a pressure-sensitive adhesive on the upper edges to cause the bags to adhere to each other. In that case the innermost bag is peeled from the remaining bags of the assembly. Suitable pressure-sensitive adhesives are well-known and may be printed on the bags after the bag manufacturing process or, alternatively, sprayed on the individual bags as each is pulled over the jig 51.

As mentioned above, the process is well adapted to a manual process. In a manual process, the bags would be placed manually on a jig which then could be inserted between the jaws of a conventional foot operated impulse sealer to seal and perforate the upper edges of the bundle in any desired fashion. The bundle would then be manually removed from the jig and packaged for sale or use in any desired fashion.

Figure 6:
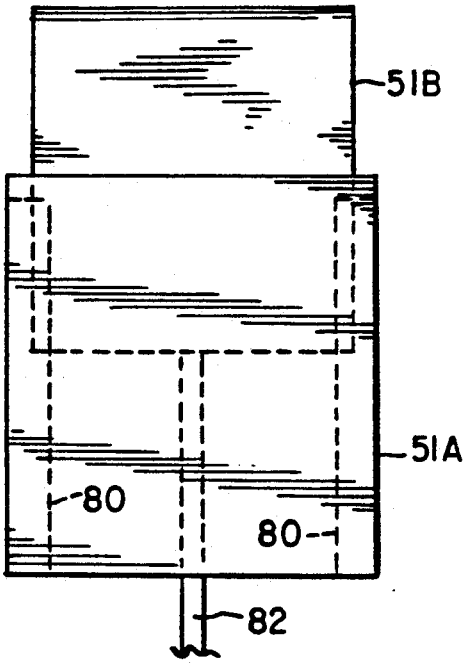
FIG. 6 is a partially diagrammatic front elevational view of a modified jig in accordance with a further embodiment of the invention.

If difficulty is encountered in assembling the bundle of bags on a jig, a two-part jig construction as shown in FIG. 6 may be employed. As shown diagrammatically in FIG. 6, the jig 51 may comprise a base section 51A and a slidable upper section 51B which can be moved relative to base sections 51A on opposed tracks 80. In FIG. 6, the jig is shown in its extended position.

In use, the upper section 51B is retracted into base section 51A and the plastic bags assembled on the retracted jig. After the bundle of bags is in place on the retracted jig, the upper section 51B is extended, for example, by means of an actuator rod 82 and conventional actuator means (not shown) such as a spring biased or pneumatic drive. It is conceivable that a retraction/extension cycle can occur as each bag is loaded onto the jig, but it is believed preferable to load an entire bundle on the retracted jig and then extend the upper section 51B to expand all of the bags concurrently.

While the present invention has been particularly shown and described in the reference to a preferred embodiment thereof, it will be understood by those skilled in the art that various changes in form and details may be made therein without departing from the spirit and scope of the invention.

What is claimed is:

1. A method of manufacturing an article of manufacture comprising a plurality of nested plastic bags for use in lining containers such as waste paper baskets comprising:

placing successive plastic bags over a jig to form a plurality of nested plastic bags, lightly adhering the upper edges of the plastic bags to each other to form a peripheral bond between contiguous bags, with none of the nested bags adhering to itself, the adherence of the bags to each other being sufficiently light that an innermost bag can be readily removed from the remaining bags, and removing the nested bags from the jig.

2. A method of manufacturing a plurality of nested plastic bags according to claim 1, including the step of perforating the bags to form separation lines to allow an innermost bag to be separated from the remaining bags.

3. A method of manufacturing a plurality of nested plastic bags according to claim 1, wherein the nested bags are removed from the jig after the upper edges of the bags have been lightly adhered together.

4. A method of manufacturing a plurality of nested plastic bags according to claim 1, wherein the bags are welded together.

5. A method of manufacturing a plurality of nested plastic bags according to claim 1, wherein the upper edges of the nested bags are adhered together by applying an adhesive to each bag.

6. A method of manufacturing an article of manufacture comprising a plurality of nested plastic bags for use in lining containers such as waste paper baskets comprising:

placing successive plastic bags in a bag opening and transport means for opening and transporting successive plastic bags over a jig to form a plurality of nested plastic bags;

moving the jig over which a plurality of nested plastic bags have been placed to a sealing means for sealing the upper edges of the plurality of nested plastic bags;

sealing the upper edges of the plurality of nested plastic bags; and removing the nested bags from the jig.

7. The method of manufacture as in claim 6 further including the step of forming plastic bags from a supply of plastic tubing for placing in the bag opening and transport means.

8. The method of manufacture as in claim 7 wherein forming of plastic bags is by cutting and sealing the plastic tubing.

9. The method of manufacture as in claim 6 wherein moving the jig is accomplished by successively rotating it a fixed number of degrees toward said sealing means.

10. An apparatus for manufacturing an article of manufacture comprising a plurality of nested plastic bags for use in lining containers such as waste paper baskets comprising:

means for opening, transporting and successively stacking plastic bags inside one another to form a plurality of nested bags;

means for sealing the upper edges of the plurality of nested plastic bags to each other to form a peripheral bond between contiguous bags, with none of the nested bags adhering to itself, and means for transferring the plurality of nested plastic bags with sealed upper edges to a packing station.

11. An apparatus as in claim 10 further including a cutting and sealing means for forming plastic bags from a supply of plastic tubing.

12. An apparatus as in claim 10 further including a means for transferring the plurality of nested plastic bags with sealed upper edges to a packing station.

13. An apparatus as in claim 12 further including a packing means for packing the plurality of nested plastic bags with sealed upper edges at the packing station.

14. An apparatus as in claim 10 wherein the sealing means further includes means for perforating the bags to form separation lines to facilitate the separation of an innermost bag from the remaining bags.

15. An apparatus as in claim 10 wherein the sealing means comprises thermal welding means.

16. An apparatus as in claim 10, wherein said means for opening, transporting and successively stacking includes a jig on which the plurality of nested bags is formed.

17. An apparatus according as in claim 16, wherein said jig comprises a base section and a second section movable with respect to said base section, means for retracting the second section relative to said base section when said plastic bags are being successively stacked inside one another, and means for extending said second section relative to said base section after a predetermined number of bags has been stacked on said jig.

* * * * *